United States Patent [19]

Strampe

[11] 4,289,255

[45] Sep. 15, 1981

[54] OIL FILTER CAP

[76] Inventor: Clarence W. Strampe, 901 S. Ruth #49, Sioux Falls, S. Dak. 57106

[21] Appl. No.: 86,251

[22] Filed: Oct. 18, 1979

[51] Int. Cl.[3] ..... B67B 7/26; F01M 11/04

[52] U.S. Cl. ..... 222/81; 222/179.5; 141/98; 141/330

[58] Field of Search ..... 222/81, 88, 179.5; 184/105 R; 141/330, 98, 329

[56] References Cited

U.S. PATENT DOCUMENTS

| | | | |
|---|---|---|---|
| 2,134,004 | 10/1938 | Pittman | 184/105 R |
| 2,685,952 | 8/1954 | Hamun et al. | 141/330 X |
| 2,687,829 | 8/1954 | Horrocks | 141/330 X |
| 2,806,635 | 9/1957 | Kader et al. | 222/88 |
| 3,990,489 | 11/1976 | Ruter | 141/330 X |
| 4,040,389 | 8/1977 | Walters | 222/81 X |

*Primary Examiner*—Robert J. Spar
*Assistant Examiner*—Frederick R. Handren
*Attorney, Agent, or Firm*—Blair, Brown & Kreten

[57] ABSTRACT

Disclosed herein is an oil filler cap for disposition upon the rocker cover in an internal combustion engine in which the opening mechanism commonly used for opening oil cans to allow the lubricant to pass within the engine is integral with the valve cap itself. Specifically, the device includes an inverted cone having a hardened tip area at its vertical extremity, an overlying protective shroud, plural openings disposed on the conical area, and an upper pinch plate for latching the cap onto the valve cover itself. Cooperating with the pinch plate is an underlying outwardly flared terminus having tab members to allow co-action with a latch upon the rocker cover.

5 Claims, 8 Drawing Figures

FIG.1
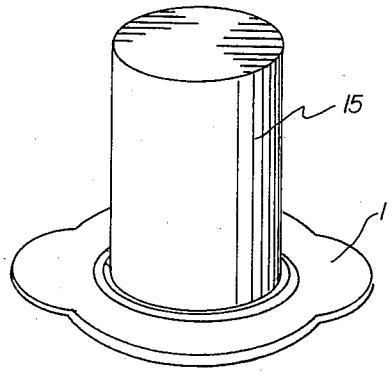
FIG.2
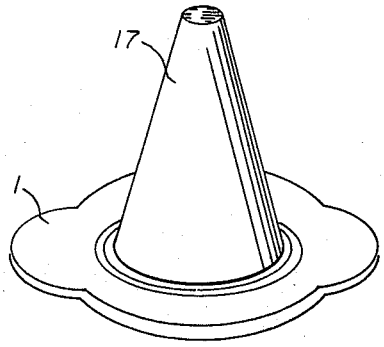
FIG.7
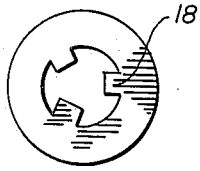
FIG.8
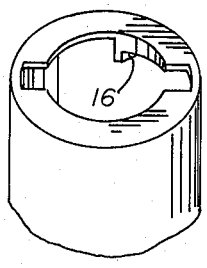
FIG.3
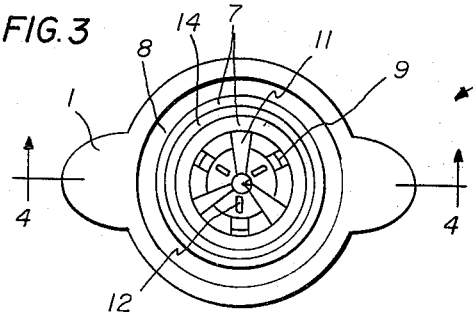
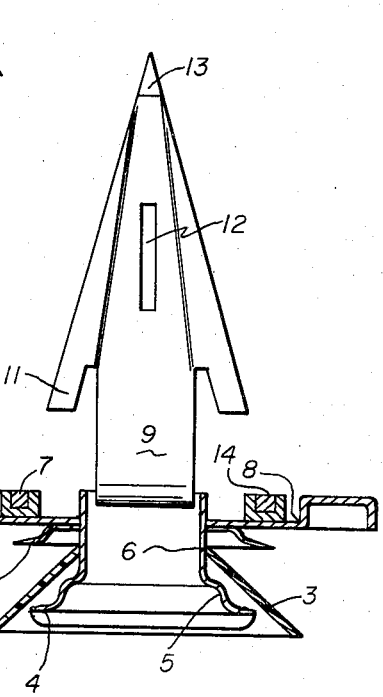
FIG.4
FIG.5
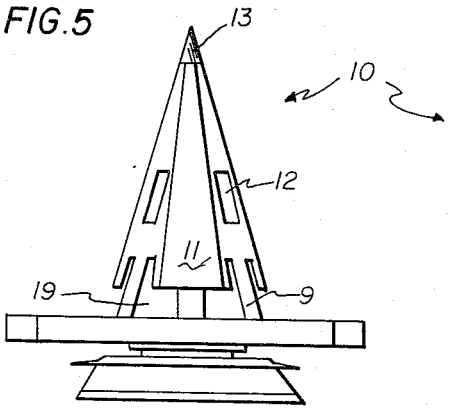
FIG.6
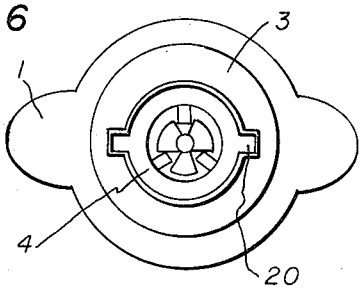

OIL FILTER CAP

BACKGROUND OF THE INVENTION

With the increasing costs of petroleum products, it becomes even more prudent to perform routine maintenance chores involving the addition of petroleum substances within an automobile by one's self. To this end, it is well known that the price of oil for an automobile engine is approximately twice as expensive when bought at a gas station as when bought at a discount store, but fewer people resort to saving money in this area because of the mess associated with putting the oil within the engine, which traditionally would take the form of pouring the oil into a funnel which thereafter enters the engine through the valve cover. Clearly, after such an operation, the funnel or similar mechanism has been contaminated and must be cleaned if it is to be allowed to be kept in a convenient spot such as an area in the car where oil drippage would be highly undesireable.

Various devices have been known to exist in the prior art which could define a can spout, and the following U.S. Pat. Nos. reflect the state of the art as it is known by applicant: 2,613,851 DuBois, 3,964,640 Laughlin.

Neither of these references either from a cursory or a detailed examination provide the structure or benefit attendant with the structure according to the present invention, and therefor any similarities that they share with the instant application appear to be merely coincidental.

SUMMARY OF THE INVENTION

Accordingly, this invention has as an object the provision of an oil filler cap which is continuously carried on the rocker cover of the automobile so that the question of storage of the spout when not in use does not become a problem.

A further object contemplates as its goal to provide a device of the character described above which is relatively inexpensive to manufacture, durable in construction, and reliable in use.

It is yet a further object of the invention to provide a device of the character described above which obviates the need for an external removable spout.

Another object contemplates providing an article of the character described above which does not interfere with normal clearances and tolerances commonly found in most engine compartments.

These and other objects will be made manifest when considering the following detailed specification when taken in conjunction with the appended drawing figures.

BRIEF DESCRIPTION OF THE DRAWINGS

FIG. 1 is a perspective view of one form of the invention with a cap disposed thereon.

FIG. 2 is an alternative configuration to that which is shown in FIG. 1.

FIG. 3 is a top plan view of the device according to the present invention with the cover removed.

FIG. 4 is a sectional view taken along lines 4—4 of FIG. 3.

FIG. 5 is a side view of that which is shown in FIGS. 3 and 4.

FIG. 6 is a bottom view of the apparatus according to the present invention.

FIG. 7 is a bottom view of the closure cap according to the present invention.

FIG. 8 depicts a typical latching mechanism found on a rocker cover device.

BRIEF DESCRIPTION OF THE PREFERRED EMBODIMENT

Referring to the drawings now, wherein like reference numerals refer to like parts throughout the several drawing figures, reference numeral 10 is directed to the oil filler cap according to the present invention.

The cap 10 can generally be regarded as having a central tubular area 6 from which emanates outwardly therefrom and therebelow a latching mechanism defined by a pinch plate 1 including a pair of diametrically opposed ears along an outer annular edge thereof. Further, an outer lip is provided which is integral with the ears and runs around the entire periphery thereof, followed inwardly by a recessed annular top groove 8, a concentric annular upstanding channel member 7 of U-shaped configuration within which a gasket 14 similar to a O-ring is provided. The U-shaped channel member surrounds the cylindrical tube portion 6 and a lowermost extremity of the tube is provided with an outwardly flared terminus 5 having a pair of diametrically opposed tab members 20 which extend beyond a flange portion 4. Disposed between the pinch plate 1 and the lowermost terminus 4 there is provided a gasket 3 and between the gasket 3 and the pinch plate there is provided a resilent spring plate 2 which operates in the following fashion: FIG. 8 details an opening or inlet which allows the ingress of oil as in a valve cover, and the opening in FIG. 8 is complementally formed to receive the terminus and tab members on the oil filler cap. Once disposed within slots complementally fashioned to the tabs, the cap is rotated so that the stepped portion 16 on the oil inlet biases the spring plate 2 and the gasket 3 so that a tight seal is provided between the terminus and the pinch plate 1.

The upper portion of the oil filler cap defines a substantially inverted conical shape in which the point thereof is provided with a hardened tip 13 and extending downwardly therefrom there is provided a flared skirt medial portion 11 for purposes to be assigned. The flared skirt medial portion terminates above the pinch plate 1 and an opening 19 allows migration of oil therethrough into the oil inlet. In a preferred form, the device would have three equispaced flared skirt medial portions separated by apertured tapering legs that extends from the tip 13 to the tube 6. FIG. 4 makes clear that the legs 9 have bent terminal portions near the connection with the tube 6 and that apertures 12 are placed between the tip 13 and the lowermost portions of the legs for allowing additional oil to pass within the inlet opening.

A cover or cap 15, 17 is provided to nest over the cone as shown, and in one form, the cap 15 is of generally cylindrical configuration, whereas in another form, the configuration (FIG. 2) approximate a truncated cone 17. An inner portion of the cap is provided with inwardly extending step areas 18 which frictionally engage the flared skirt medial portion having the thickened outwardly extending contour 11.

In use and operation, the cap which resides over the seal 14 thereby retaining vapor within the cap is removed, and a container of oil is skewered by placing it on the hardened tip 13. It has been found that the device works best when the tip 13 engages one quadrant of the top rather than the exact center of the can and after penetration has been made pushing the can further down on the cone assures that a rapid evacuation of oil from the can be obtained.

Having thus described the invention, it should be apparent that numerous structural modifications are contemplated as being a part of this invention as set forth herein above and as defined herein below by the claims.

What is claimed is:

1. An oil filler cap comprising in combination:

a tube with latching means on a lower portion thereof for attachment to an oil inlet on a car, a hardened tip on a top portion of said tube used to puncture an oil can, a flared skirt medial portion tapering towards said tip of said tube between said upper and lower portions provided with openings therethrough, whereby when an oil can is punctured on said tip and forced on said flared skirt medial portion, the puncture is enlarged and oil passes through said openings down said tube and into the oil inlet of the car, an overlying protective cap extending over said tip and tapering medial portion whereby when not in use said tip is not exposed and oil vapors are contained within said cap, said latching means comprises an outwardly flared terminus on the lowermost portion of said tube, at least two tab members extending outwardly from said terminus, and a pinch plate above said terminus extending outwardly from said tube whereby said terminus is placed below the oil inlet and said pinch plate thereabove, said tab members oriented to pass through the inlet and when rotated will force and secure said pinch plate down and around said inlet, and said pinch plate comprises an annular flange extending outwardly from said tube having diametrically opposed ears along an outer periphery thereof, an outer lip integral with said ears, a recessed annular top groove within said outer lip, a concentric annular upstanding channel member within said groove and a circular recess within said channel member.

2. The device of claim 1 wherein a gasket is provided between said pinch plate and said terminus to provide a vapor seal when tightened against an area around the oil inlet, and an annular seal resides within said circular recess to provide a tight fit with said cap which sits thereon.

3. The device of claim 1 in which a spring plate is disposed between said pinch plate and said gasket for providing tension along the vapor seal area.

4. The device of claim 2 in which said cap frictionally engages said flared skirt medial portion along a thickened outwardly extending portion thereof.

5. The device of claim 4 wherein said cap has inwardly disposed step areas for engagement with said thickened outwardly extending portion.

* * * * *

UNITED STATES PATENT AND TRADEMARK OFFICE

CERTIFICATE OF CORRECTION

PATENT NO. : 4,289,255

DATED : September 15, 1981

INVENTOR(S) : Clarence W. Strampe

It is certified that error appears in the above–identified patent and that said Letters Patent are hereby corrected as shown below:

The title of the patent should be

OIL FILLER CAP

Signed and Sealed this

*Fifteenth* Day of *December 1981*

[SEAL]

*Attest:*

GERALD J. MOSSINGHOFF

*Attesting Officer*

*Commissioner of Patents and Trademarks*